United States Patent [19]

Suzuki

[11] Patent Number: 4,938,198

[45] Date of Patent: Jul. 3, 1990

[54] INTERNAL COMBUSTION ENGINE

[75] Inventor: Michio Suzuki, Hekinan, Japan

[73] Assignee: Toyota Jidosha Kabushiki Kaisha, Japan

[21] Appl. No.: 398,623

[22] Filed: Aug. 25, 1989

[30] Foreign Application Priority Data

Aug. 30, 1988 [JP] Japan ..... 63-215492

[51] Int. Cl.[5] ..... F02M 25/07

[52] U.S. Cl. ..... 123/571; 123/478

[58] Field of Search ..... 123/478, 480, 486, 494, 123/568, 571

[56] References Cited

U.S. PATENT DOCUMENTS

| | | | |
|---|---|---|---|
| 4,448,178 | 5/1984 | Yamato et al. | 123/571 |
| 4,553,518 | 11/1985 | Takao et al. | 123/571 X |
| 4,598,684 | 7/1986 | Kato et al. | 123/478 |
| 4,782,810 | 11/1988 | Shimoda et al. | 123/571 |
| 4,823,760 | 4/1989 | Nishida | 123/571 |
| 4,881,509 | 11/1989 | Ohashi et al. | 123/571 |

FOREIGN PATENT DOCUMENTS

| | | |
|---|---|---|
| 60-50241 | 3/1985 | Japan . |
| 60-169641 | 9/1985 | Japan . |
| 63-131840 | 6/1988 | Japan . |

*Primary Examiner*—Willis R. Wolfe

*Attorney, Agent, or Firm*—Kenyon & Kenyon

[57] ABSTRACT

An internal combustion engine including a calculating device for calculating an amount of fuel to be injected on the basis of a pressure in an intake passage downstream of a throttle valve, a first correction device for calculating a transient correction value on the basis of a changing rate of the pressure and for correcting the amount of fuel on the basis of the transient correction value, a determining device for determining whether or not the recirculation of exhaust gas in an exhaust passage into the intake passage is started, or whether or not the recirculation is stopped, and a second correction device for reducing an absolute value of the transient correction value in accordance with an amount of recirculated exhaust gas when the determining device determines that the recirculation is started or stopped.

17 Claims, 4 Drawing Sheets

INTERNAL COMBUSTION ENGINE

BACKGROUND OF THE INVENTION

1. Field of the Invention

The present invention relates to an internal combustion engine.

2. Description of the Related Art

It is well known to reduce the amount of production of $NO_x$ by recirculating part of the exhaust gas in an exhaust passage of an engine into an intake passage, i.e., to use EGR (exhaust gas recirculation).

On the other hand, Japanese Unexamined Patent Publication No. 63-131840 and No. 60-50241 disclose devices for controlling the amount of fuel to be injected. The devices can inject the proper amount of fuel into an intake port even when an engine is in a transient operating state, for example, an acceleration state or deceleration state. In this kind of the device, the basic amount of fuel to be injected is calculated on the basis of the engine speed and the pressure in the intake passage downstream of a throttle valve. When the engine is in a transient state, the difference between a successively detected first pressure and second pressure in the intake passage downstream of the throttle valve is calculated. The basic amount of fuel to be injected is corrected by a transient correction value in accordance with the difference.

However, when this device for controlling the amount of fuel to be injected is applied to an engine which has an EGR device, the following problem arises.

Referring to FIG. 4, when the engine is in an accelerating state, the pressure PM in the intake passage downstream of the throttle valve increases. During the acceleration, when the recirculation of the exhaust gas into the intake passage is started (at t1), the pressure PM rapidly increases due to the recirculation of the exhaust gas. However, as no fresh air is contained in the exhaust gas recirculated by the EGR device, the pressure PM does not exactly represent the amount of air fed into the engine cylinders, because the pressure PM contains an error corresponding to the pressure of the recirculated exhaust gas. Accordingly, when the transient correction value is calculated on the basis of the difference $\Delta PM$ ($=PM-PMO$) between a first pressure PMO detected at t0 when the EGR operation is not carried out and a second pressure successively detected at t2 when the EGR operation is carried out, the transient correction value does not exactly represent the engine operating state and thus the air-fuel mixture fed into the engine cylinders becomes extremely rich.

Referring to FIG. 5, when the engine is decelerating, the pressure PM falls. During the deceleration, when the recirculation of the exhaust gas into the intake passage is stopped (at t4), the pressure PM rapidly falls. Accordingly, when the transient correction value is calculated on the basis of the difference $\Delta PM$ between a third pressure detected at t3 when the EGR operation is carried out and a fourth pressure successively detected at t5 when the EGR operation is not carried out, the transient correction value does not exactly represent the engine operating state and thus the air-fuel mixture fed into the engine cylinders becomes extremely lean.

Namely, a problem occurs in that the air-fuel ratio differs considerably from the stoichiometric air-fuel ratio when the EGR operation is started or stopped during a transient engine operating state, for example acceleration or deceleration.

Also, due to this problem, a problem occurs in that the toxic components in the exhaust gas increase when the EGR operation is started or is stopped.

SUMMARY OF THE INVENTION

An object of the present invention is to provide an internal combustion engine capable of exactly controlling an air-fuel ratio even when the EGR operation is started or stopped during a transient engine operating state.

According to the present invention, there is provided an internal combustion engine having an intake passage and an exhaust passage including: a throttle valve arranged in the intake passage; a pressure detecting means for detecting a pressure in the intake passage downstream of the throttle valve; a calculating means for calculating an amount of fuel to be injected on the basis of the pressure detected by the pressure detecting means; a fuel injection means for injecting fuel into the intake passage on the basis of the amount of fuel; a first correction means for calculating a transient correction value on the basis of a changing rate of the pressure detected by the pressure detecting means and for correcting the amount of fuel on the basis of the transient correction value; an exhaust gas recirculation means for recirculating a part of the exhaust gas in the exhaust passage into the intake passage; a determining means for determining whether or not the recirculation of the exhaust gas into the intake passage is started or whether or not the recirculation is stopped, and a second correction means for reducing an absolute value of the transient correction value in accordance with an amount of exhaust gas recirculated by the exhaust gas recirculation means when the determining means determines that the recirculation is started or stopped.

The present invention may be more fully understood from the description of preferred embodiments of the invention set forth below, together with the accompanying drawings.

DESCRIPTION OF THE PREFERRED EMBODIMENTS

Figure 1:
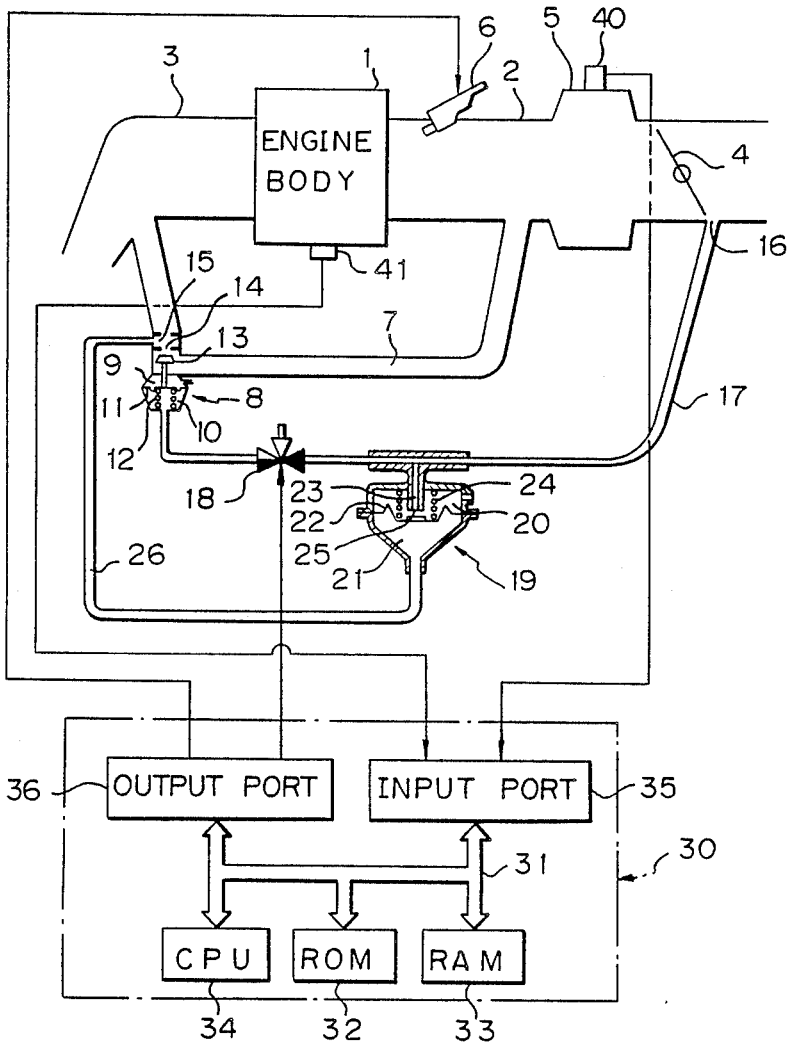
FIG. 1 is a schematic view of an engine.

Referring to FIG. 1, reference numeral 1 designates an engine body, 2 an intake passage, and 3 an exhaust passage. A throttle valve 4 is arranged in the intake passage 2, a surge tank 5 is arranged in the intake passage 2 downstream of the throttle valve 4, and a fuel injector 6 is arranged in the intake passage 2 near the engine body 1.

An EGR passage 7 connects the exhaust passage 3 to the intake passage 2 downstream of the surge tank 5, and a vacuum operated control valve 8 is arranged in the EGR passage 7. The vacuum operated control valve 8 includes an atmospheric pressure chamber 9 and a vacuum chamber 10 which are defined in the vacuum operated control valve 8 by a diaphragm 11. A compressing spring 12 for biasing the diaphragm 11 is arranged in the vacuum chamber 10, and a valve head 13 which opens and closes an EGR port 14 is secured to the diaphragm 11. The EGR port 14 is provided in a wall which defines a constant pressure chamber 15 arranged in the EGR passage 7.

The vacuum chamber 10 is connected to a sensing port 16 via a vacuum passage 17. The sensing port 16 is open to the intake passage 2 upstream of the throttle valve 4 when the throttle valve 4 is in the idling position and is open to the intake passage 2 downstream of the throttle valve 4 when the throttle valve 4 is open.

A vacuum supply control valve 18 controlled by an electronic control unit 30 is arranged in the vacuum passage 17. The vacuum supply control valve 18 communicates the vacuum chamber 10 with the sensing port 16 when the vacuum supply control valve 18 is ON and communicates the vacuum chamber 10 with the atmosphere when the vacuum supply control valve 18 is OFF. A modulator 19 is arranged in the vacuum passage 17 between the sensing port 16 and the vacuum supply control valve 18. The modulator 19 includes an atmospheric pressure chamber 20 and a pressure controlling chamber 21 which are defined in the modulator 19 by a diaphragm 22.

In the atmospheric pressure chamber 20, an air bleed pipe 23 and a compressing spring 24 for biasing the diaphragm 22 are arranged. The air bleed pipe 23 is communicated with the vacuum passage 17 at the upper end of the air bleed pipe 23, and an opening 25 facing to the diaphragm 22 is formed at the lower end of the air bleed pipe 23. The pressure controlling chamber 21 is communicated with the constant pressure chamber 15 via a conduit 26.

The electronic control unit 30 is constructed as a digital computer and includes a ROM (read only memory) 32, a RAM (random access memory) 33, a CPU (microprocessor, etc.) 34, an input port 35, and an output port 36. The ROM 32, the RAM 33, the CPU 34, the input port 35, and the output port 36 are interconnected via a bidirectional bus 31. A pressure sensor 40 for detecting an absolute pressure in the intake passage 2 downstream of the throttle valve 4 is arranged in the surge tank 5 and is connected to the input port 35. A crank angle sensor 41 generates a pulse at predetermined crank angles. The pulses output by the crank angle sensor 41 are input to the input port 35. The engine speed is calculated on the basis of the pulses output by the crank angle sensor 41. The output port 36 is connected to the fuel injector 6 and the vacuum supply control valve 18.

When the vacuum supply control valve 18 is OFF, the vacuum chamber 10 of the vacuum operated control valve 8 communicates with the atmosphere. Accordingly, the EGR port 14 is closed by the valve head 13, and thus exhaust gas in the exhaust passage 3 is not recirculated into the intake passage 2, i.e., the EGR operation is not carried out. On the other hand, when the engine operating state is in a predetermined operating state, the vacuum supply control valve 18 is on and the vacuum chamber 10 communicates with the sensing port 16. Accordingly, the EGR port 14 is opened in accordance with the level of vacuum in the vacuum chamber 10, and thus a part of exhaust gas in the exhaust passage 3 is recirculated into the intake passage 2 via the EGR passage 7, i.e., an EGR operation is carried out.

When the pressure in the constant pressure chamber 15 becomes slightly higher than a predetermined pressure which is slightly higher than the atmospheric pressure, the diaphragm 22 of the modulator 19 rises against the spring force of the compressing spring 24. As a result of this, a flowing resistance at the opening 25 of the air bleed pipe 23 is increased, and thus the level of vacuum in the vacuum chamber 10 becomes higher. Accordingly, the valve head 13 moves downward against a spring force of the compressing spring 12 and thus the flowing area of the EGR port 14 is increased. Therefore the pressure in the constant pressure chamber 15 becomes lower. When the pressure in the constant pressure chamber 15 becomes slightly lower than the predetermined pressure, the diaphragm 22 of the modulator 19 moves downward. As a result of this, the flowing resistance at the opening 25 of the air bleed pipe 23 is reduced, and thus the level of vacuum in the vacuum chamber 10 becomes lower. Accordingly, the valve head 13 of the vacuum operated control valve 8 rises and thus the flowing area of the EGR port 14 is reduced. Therefore the pressure in the constant pressure chamber 15 becomes higher. By the above-mentioned operation of the vacuum operated control valve 8 and the modulator 19, the amount of exhaust gas recirculated into the intake passage 2 is approximately proportional to the amount of air fed into the engine cylinders.

Figure 2:
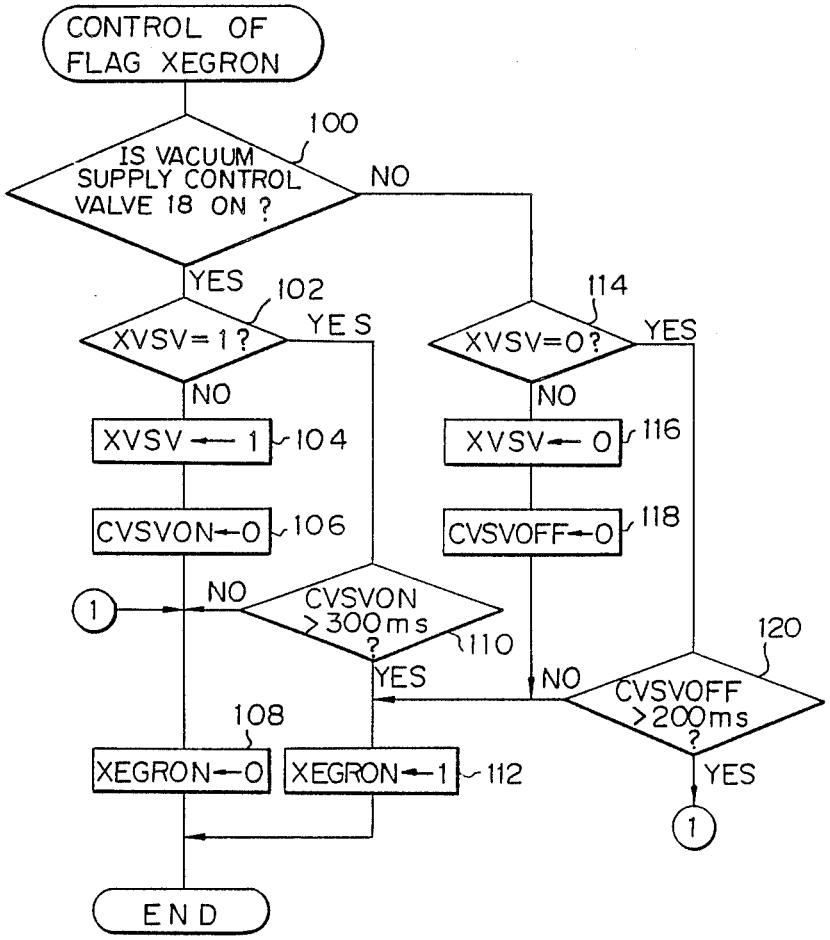
FIG. 2 is a flow chart for controlling the EGR flag XEGRON.

FIG. 2 illustrates a routine for determining whether or not the EGR operation is carried out. The routine illustrated in FIG. 2 is processed by sequential interruptions executed at predetermined intervals.

Referring to FIG. 2, in step 100, it is determined whether or not the vacuum supply control valve 18 is ON. When the vacuum supply control valve 18 is ON, the routine goes to step 102, where it is determined whether or not a flag XVSV is equal to 1. The flag XVSV represents whether or not the vacuum supply control valve 18 was ON in the processing cycle immediately preceding the present processing cycle. When the flag XVSV is equal to 1, the vacuum supply control valve 18 was ON in the preceding processing cycle, and when the flag XVSV is equal to 0, the vacuum supply control valve 18 was OFF in the preceding processing cycle. When the flag XVSV is equal to 0, i.e., when the vacuum supply control valve 18 changes from the ON state to OFF state, the routine goes to step 104, where the flag XVSV is made 1. In step 106, an ON time counter CVSVON is cleared and starts to count. In step 108, an EGR flag XEGRON is reset, and the processing cycle is completed.

The EGR flag XEGRON represents whether or not the EGR operation is carried out. When the EGR flag XEGRON is equal to 1, the EGR operation is being carried out, and when the EGR flag XEGRON is equal to 0, the EGR operation is not being carried out. In step 102, when the flag XVSV is equal to 1, the routine goes to step 110. In step 110, it is determined whether or not the ON time counter CVSVON is larger than 300 msec. When CVSVON≦300 msec, the routine goes to step 108, and the EGR flag XEGRON is maintained at 0. In step 110, when CVSVON≦300 msec, the routine goes to step 112, and the EGR flag XEGRON is made 1.

Namely, in step 100 through step 112, the EGR flag XEGRON is set, i.e., it is determined that the EGR operation is carried out, when 300 msec elapses from the time by which the vacuum supply control valve 18 is changed from the OFF state to ON state. The reason is that it takes 300 msec from the time by which the vacuum supply control valve 18 changed from the OFF state to ON state before the vacuum operated control valve 8 opens the EGR port 14.

In step 100, when the vacuum supply control valve 18 is not ON, the routine goes to step 114, where it is determined whether or not the flag XVSV is equal to 0. When the flag XVSV is equal to 1, i.e., when the vacuum supply control valve 18 was ON in the preceding processing cycle, the routine goes to step 116, where the flag XVSV is made 0. In step 118, an OFF time counter CVSVOFF is cleared and starts to count. Then the routine goes to step 112, where the EGR flag XEGRON is maintained at 1. In step 114, when the flag XVSV is equal to 0, the routine goes to step 120, and it is determined whether or not the OFF time counter CVSVOFF is larger than 200 msec. When CVSVOFF≦200 msec, the routine goes to step 112, where the EGR flag XEGRON is maintained at 1. Conversely when CVSVOFF>200 msec, the routine goes to step 108, where the EGR flag XEGRON is made 0.

Namely, the EGR flag XEGRON is reset, i.e., it is determined that the EGR operation is not carried out, when 200 msec elapses from the time which the vacuum supply control valve 18 is changed from the ON state to OFF state. The reason is that it takes 200 msec from the time at which the vacuum supply control valve 18 changed from the ON state to the OFF state before the vacuum operated control valve 8 closes the EGR port 14.

Figure 3:
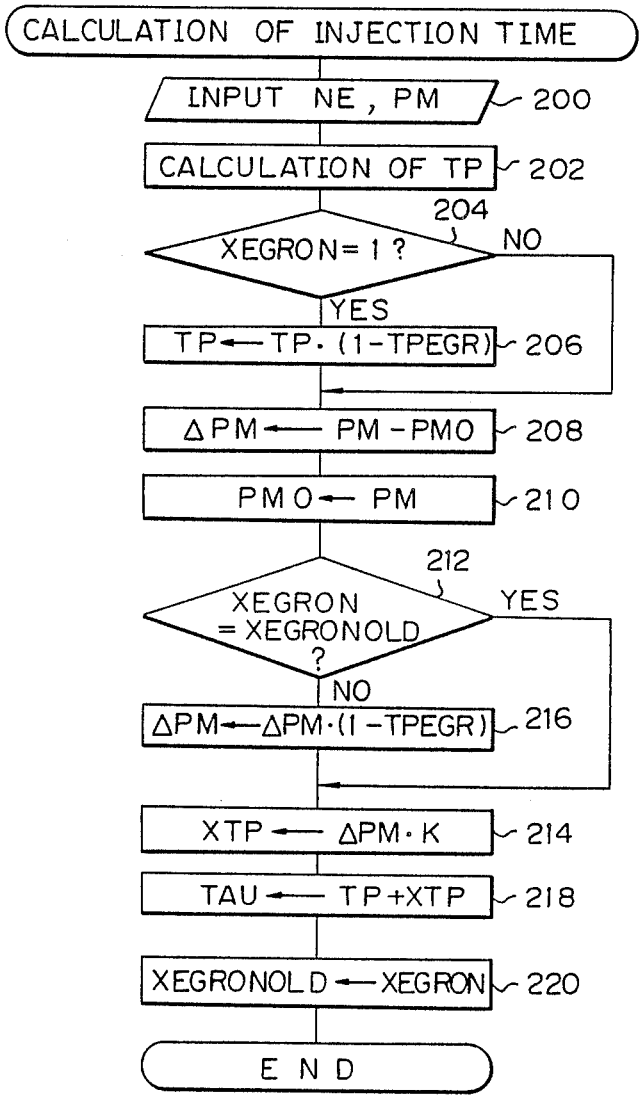
FIG. 3 is a flow chart for calculating an injection time TAU.
Figure 4:
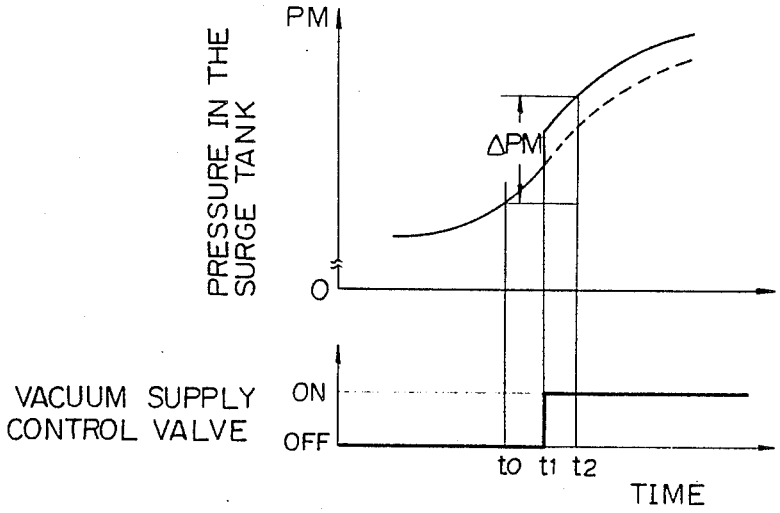
FIG. 4 is a time chart showing changes in the pressure PM in a surge tank during acceleration.
Figure 5:
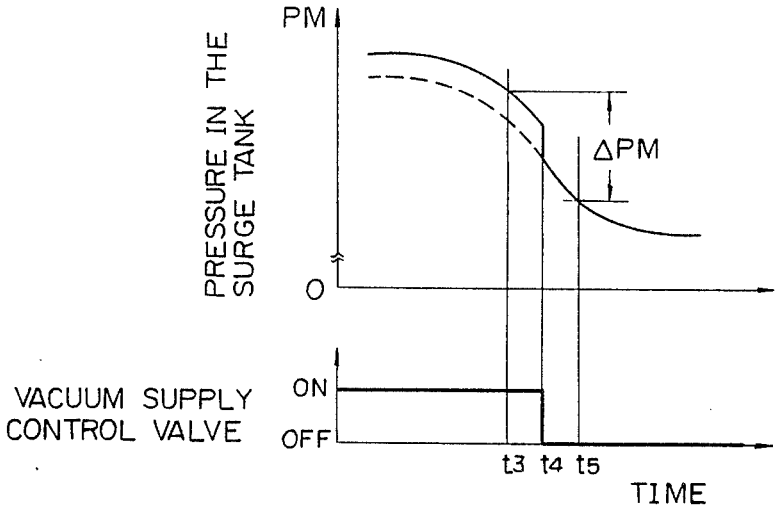
FIG. 5 is a time chart showing changes in the pressure PM in a surge tank during deceleration.

FIG. 3 illustrates a routine for the calculation of the injection time. This routine is processed by sequential interruptions executed at predetermined crank angles.

Referring to FIG. 3, in step 200, the engine speed NE and the pressure PM in the surge tank 5 are input to the CPU 34, and in step 202, the basic injection time TP is calculated from the engine speed NE and the pressure PM in the surge tank 5. The relationship between the basic injection time TP and the engine speed NE and pressure PM is predetermined by experiments so that when fuel is injected during the basic injection time TP, the air-fuel mixture fed into the engine cylinders becomes a predetermined air-fuel ratio, for example, the stoichiometric air-fuel ratio, in a stable engine operating state. The relationship is prememorized in the ROM 32. In step 204, it is determined whether or not the EGR flag XEGRON is equal to 1, i.e., whether or not the EGR operation is being carried out. When the EGR flag XEGRON is equal to 1, i.e., the EGR operation is being carried out, the routine goes to step 206, and the basic injection time TP is corrected as shown in the following expression:

$$TP\cdot(1-TPEGR)$$

where, TPEGR represents a EGR ratio, and this EGR ratio is calculated from the following equation:

$$TPEGR=Q_{EGR}/Q_A$$

Where, $Q_{EGR}$: amount of exhaust gas recirculated into intake passage $Q_A$: amount of air fed into engine cylinders In step 204, when the EGR flag XEGRON is not equal to 1, i.e., the EGR operation is not being carried out, the routine goes to step 208, where a changing rate ΔPM of the pressure PM in the surge tank 5 is calculated from the following equation:

$$\Delta PM=PM-PMO$$

where, PM is an absolute pressure in the surge tank 5 in a present processing cycle, and PMO is an absolute pressure in the surge tank 5 in a previous processing cycle immediately before the present processing cycle. Accordingly the changing rate ΔPM represents the level of the change of the pressure PM at the predetermined crank angle. In step 210, the pressure PM is memorized as PMO. In step 212, it is determined whether or not the EGR flag XEGRON is equal to the previous EGR flag XEGRONOLD. The previous EGR flag XEGRONOLD is the EGR flag XEGRON in a previous processing cycle immediately before the present processing cycle. When XEGRON=XEGRONOLD, the routine goes to step 214 and the transient correction value XTP is calculated from the following equation:

$$XTP=\Delta PM\cdot K$$

where, K is a coefficient predetermined on the basis of the temperature of the cooling water and engine speed.

Conversely, in step 212, when it is determined that the EGR flag XEGRON is not equal to the previous EGR flag XEGRONOLD, the routine goes to step 216 and the changing rate ΔPM is corrected as shown in the following expression:

$$\Delta PM\cdot(1-TPEGR)$$

In this case, the routine goes to step 214 and the transient correction value XTP is calculated from the following equation:

$$XTP=\Delta PM\cdot(1-TPEGR)\cdot K$$

Then, in step 218, the actual injection time TAU is calculated from the following equation.

$$TAU=TP+XTP$$

Note, when the engine is in an acceleration state, as the changing rate ΔPM of the pressure is more than 0, the transient correction value XTP becomes larger than 0, and when the engine is in a deceleration state, as the change rate ΔPM of the pressure is less than 0, the transient correction value XTP becomes less than 0. Accordingly in the acceleration state, the amount of fuel to be injected is increased, and in the deceleration state, the amount of fuel to be injected is reduced. Furthermore, the amount of fuel to be injected is reduced in accordance with the reduction in the transient correction XTP.

In step 220, the EGR flag XEGRON is memorized as XEGRONOLD, and then the routine is completed.

In this routine, when it is determined that the recirculation of the exhaust gas into the intake passage 2 is started or stopped between the present processing cycle and the previous processing cycle immediately before the present processing cycle, the absolute value of the changing rate ΔPM of the pressure is reduced in accordance with an increase in the amount of exhaust gas recirculated into the intake passage 2. Accordingly, the changing rate ΔPM exactly represents the changing rate of the amount of air fed into the engine cylinders. Consequently, the air-fuel ratio can be prevented from deviating from the stoichiometric air-fuel ratio, and the air-fuel ratio can be maintained at approximately the stoichiometric air-fuel ratio.

Furthermore an increase of the toxic components in the exhaust gas can be prevented and also deterioration of the drivability can be prevented.

Although the invention has been described with reference to specific embodiments chosen for purposes of illustration, it should be apparent that numerous modifications can be made without departing from the basic concept and scope of the invention.

I claim:

1. An internal combustion engine having an intake passage and an exhaust passage, comprising:

a throttle valve arranged in the intake passage;

a pressure detecting means for detecting a pressure in the intake passage downstream of said throttle valve;

a calculating means for calculating an amount of fuel to be injected on the basis of said pressure detected by said pressure detecting means;

a fuel injection means for injecting fuel into the intake passage on the basis of said amount of fuel;

a first correction means for calculating a transient correction value on the basis of a changing rate of said pressure detected by said pressure detecting means and for correcting said amount of fuel on the basis of said transient correction value;

an exhaust gas recirculation means for recirculating a part of the exhaust gas in the exhaust passage into the intake passage;

a determining means for determining whether or not the recirculation of the exhaust gas into the intake passage is started, or whether or not said recirculation is stopped; and a second correction means for reducing an absolute value of said transient correction value in accordance with an amount of exhaust gas recirculated by said exhaust gas recirculation means when said determining means determines that said recirculation is started or stopped.

2. An internal combustion engine according to claim 1, wherein said first correction means reduces said amount of fuel is reduced in accordance with a reduction in said transient correction value.

3. An internal combustion engine according to claim 2, wherein said second correction means reduces said absolute value of said transient correction value in accordance with an increase in said amount of exhaust gas recirculated.

4. An internal combustion engine according to claim 2, wherein said second correction means reduces said absolute value of said transient correction value by reducing an absolute value of said changing rate of said pressure.

5. An internal combustion engine according to claim 1, further comprising an engine speed detecting means for detecting an engine speed, wherein said calculating means calculates said amount of fuel on the basis of said pressure and said engine speed detected by said engine speed detecting means.

6. An internal combustion engine according to claim 1, wherein said calculating means calculates said amount of fuel so that an air-fuel mixture fed into an engine cylinder becomes a predetermined air-fuel ratio in a stable engine operating state.

7. An internal combustion engine according to claim 6, wherein said predetermined air-fuel ratio is a stoichiometric air-fuel ratio.

8. An internal combustion engine according to claim 1, wherein said pressure detecting means is a absolute pressure detecting sensor.

9. An internal combustion engine according to claim 1, wherein said changing rate of said pressure is represented by a difference between pressures successively detected by said pressure detecting means.

10. An internal combustion engine according to claim 9, wherein said pressure detecting means detects said pressure at a predetermined crank angle.

11. An internal combustion engine according to claim 1, wherein said first correction means calculates said transient correction value as a product of said changing rate of said pressure and a predetermined coefficient.

12. An internal combustion engine according to claim 1, further comprising a third correction means for reducing said amount of fuel in accordance with an increase in said amount of exhaust gas recirculated by said exhaust gas recirculation means when said recirculation is carried out.

13. An internal combustion engine according to claim 1, wherein said exhaust gas recirculation means comprises a recirculation passage connecting the inlet passage to the exhaust passage, and a recirculation control valve arranged in said recirculation passage and controlled by control signals indicating that said recirculation control valve to be closed and opened, and said determining means determines whether or not said recirculation is started or whether or not said recirculation is stopped, on the basis of said control signals.

14. An internal combustion engine according to claim 13, wherein said determining means determines that said recirculation is started when a predetermined first delay time has passed from the time at which said control signal indicating that said recirculation control valve to be opened was output to said recirculation control valve, and said determining means determines that said recirculation is stopped when a predetermined second delay time has passed from the time at which said control signal indicating that said recirculation control valve to be closed was output to said recirculation control valve.

15. An internal combustion engine according to claim 14, wherein said first delay time is longer than said second delay time.

16. An internal combustion engine according to claim 13, wherein said recirculation control valve comprises a vacuum operated control valve arranged in said recirculation passage and a vacuum supply control valve for controlling a supply of vacuum to said vacuum operated control valve by said control signals, and said vacuum operated control valve is opened when vacuum is supplied to said vacuum operated control valve and is closed when vacuum is not supplied.

17. An internal combustion engine according to claim 16, further comprising a vacuum level regulating means for regulating a level of vacuum supplied to said vacuum operated control valve, wherein a degree of opening of said vacuum operated control valve is controlled by said level of vacuum regulated by said vacuum level regulating means.

* * * * *

UNITED STATES PATENT AND TRADEMARK OFFICE

CERTIFICATE OF CORRECTION

PATENT NO. : 4,938,198

DATED : July 3, 1990

INVENTOR(S) : Michio SUZUKI

It is certified that error appears in the above-identified patent and that said Letters Patent is hereby corrected as shown below:

Column 5, line 57, change "represents a EGR" to --represents an EGR--.

Column 7, line 46, delete "is reduced".

Column 8, line 7, change "a absolute" to --an absolute--.

Signed and Sealed this

Twelfth Day of November, 1991

*Attest:*

HARRY F. MANBECK, JR.

*Attesting Officer*

*Commissioner of Patents and Trademarks*